US005125700A

United States Patent [19]

Fattori et al.

[11] Patent Number: 5,125,700

[45] Date of Patent: Jun. 30, 1992

[54] SECURITY SEAL

[76] Inventors: Lazzaro A. Fattori, 400 N. Flagler Dr., Apt. 505, West Palm Beach, Fla. 33401; James G. Fattori, 6401 Lantana Pines Dr., Lantana, Fla. 33462; Paul L. Fattori, 400 N. Flagler Dr., Apt. 505, West Palm Beach, Fla. 33401

[21] Appl. No.: 559,688

[22] Filed: Jul. 30, 1990

[51] Int. Cl.[5] ..... B65D 33/34

[52] U.S. Cl. ..... 292/318; 292/322; 292/307 A; 439/271

[58] Field of Search ..... 292/307 R, 318, 319, 292/320, 321-331, 307 A; 70/440; 439/271 X, 587; 385/138, 139

[56] References Cited

U.S. PATENT DOCUMENTS

| | | | |
|---|---|---|---|
| 932,159 | 8/1909 | Miller | 292/318 |
| 2,653,400 | 9/1953 | Sutherland . | |
| 3,265,426 | 8/1966 | Brooks et al. . | |
| 3,326,589 | 6/1967 | Wenk, Jr. . | |
| 3,463,532 | 8/1969 | Chidley et al. . | |
| 3,975,040 | 8/1976 | Van Gompel | 292/318 |
| 4,095,872 | 6/1978 | Stieff et al. | 70/440 |
| 4,161,348 | 7/1979 | Ulrich | 70/440 |
| 4,180,301 | 12/1979 | Hutter | 439/271 |
| 4,447,123 | 5/1984 | Page et al. | 70/440 |
| 4,640,570 | 2/1987 | Strate | 439/271 |
| 4,664,432 | 5/1987 | Swift | 292/318 |
| 4,673,922 | 6/1987 | Denis et al. | 292/307 A |
| 4,676,575 | 6/1987 | Denlinger et al. | 439/271 |
| 4,729,626 | 3/1988 | Stieff . | |
| 4,811,977 | 3/1989 | Swift et al. | 292/318 |
| 4,982,985 | 1/1991 | Atlas | 292/307 R |

FOREIGN PATENT DOCUMENTS

| | | | |
|---|---|---|---|
| 0102405 | 3/1984 | France | 292/318 |
| 2164003 | 3/1986 | United Kingdom | 292/318 |

OTHER PUBLICATIONS

*Microseal*, Unisto, Inc., Aug., 1989.

*Adapting Tyden Seals to Special Situations*, The Tyden Seal Company, Sep., 1989.

*Plastic Truck Seal*, Stoffel Seals Corporation, Mar., 1990.

*Model* 9001 *Pull-Up Seal*, American Casting & Manufacturing Corporation.

*Tamper-Resistant Seals for Security*, Stoffel Seals Corporation.

*Brooks Camera Verifier for the Fiber-Lock Seal*, E. J. Brooks Company, Jun., 1989.

*Brooks Fiber-Lock Seal*, E. J. Brooks Company, Mar., 1989.

*Brooks Rod-Loks*, E. J. Brooks Company, Sep., 1988.

*Primary Examiner*—Renee S. Luebke

*Assistant Examiner*—Darnell M. Boucher

*Attorney, Agent, or Firm*—Harry W. Barron

[57] ABSTRACT

A security seal includes a first seal member having a first locking portion and a first detection circuit portion. A second seal member has a second locking portion and a second detection circuit portion. The first locking portion is engagable to the second locking portion to engage and irretrievably lock together the first seal member to the second seal member. Engagement of the first seal member to the second seal member operatively connects the first detection circuit portion to the second detection circuit portion to provide a combined detection circuit throughout the security seal. In a preferred embodiment, the first seal member includes a spear having the first locking portion, and the second seal member includes a sleeve having the second locking portion. The spear is insertable into the sleeve to engage the first locking portion to the second locking portion, and to thereby engage the first seal member and the first detection circuit portion to the second seal member and the second detection circuit portion. Breaking of the security seal will break continuity of the combined detection circuit portions, which continuity is checked for evidence of tampering.

24 Claims, 17 Drawing Sheets

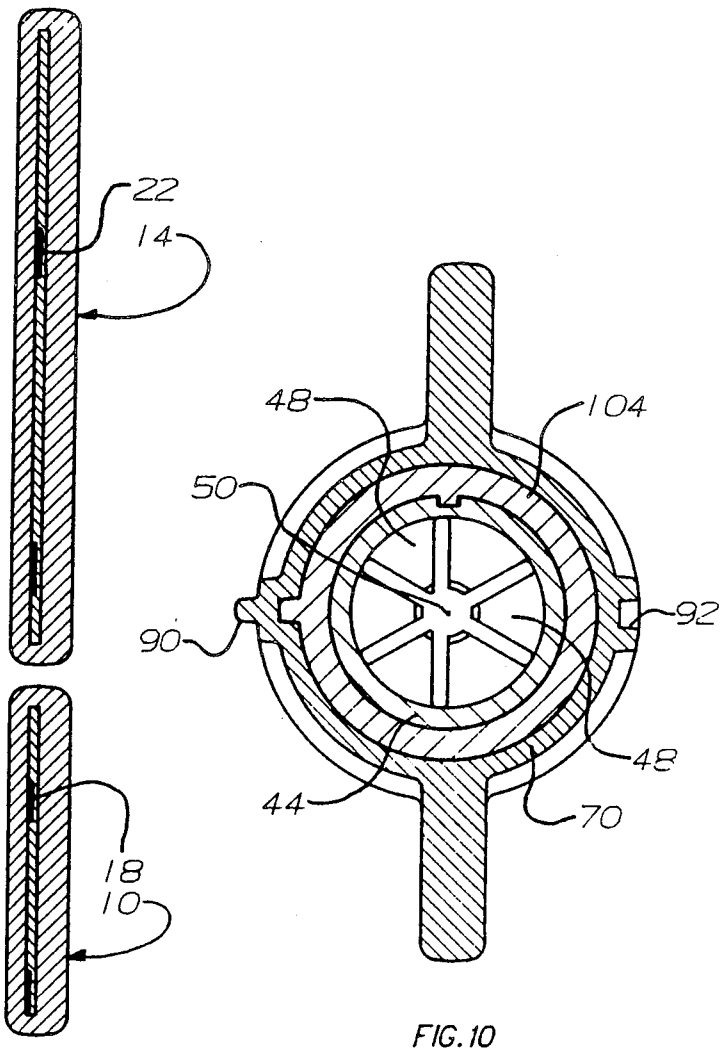
FIG. 10
FIG. 9
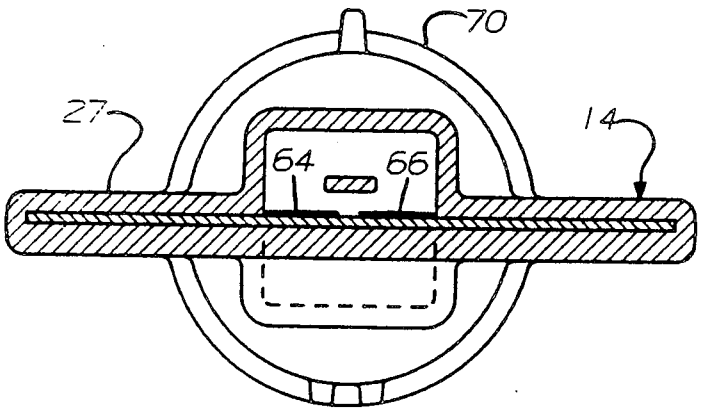
FIG. 5
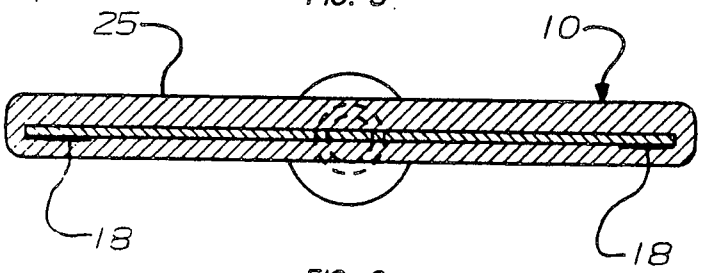
FIG. 6
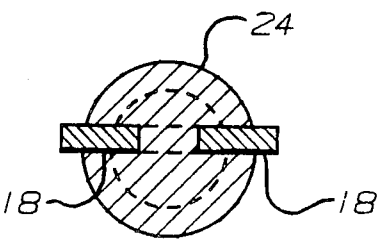
FIG.8
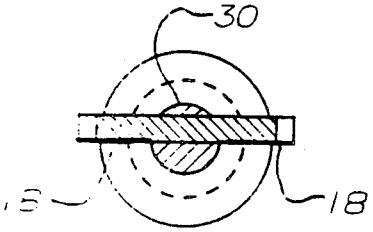
FIG. 7

SECURITY SEAL

BACKGROUND OF THE INVENTION

1. Field of the Invention

This invention relates generally to security seals for closures, especially the lids and doors of shipping containers, and relates more particularly to tamper-indicating security seals.

2. Description of the Prior Art

Smuggling of drugs and other contraband has become a well-documented problem in the transportation industry. Smugglers work very hard to enter containers on cargo vessels, airplanes and the like to conceal contraband for transportation purposes. Aside from the social problems which such smuggling causes, transportation companies face large government-imposed fines, and possible confiscation of equipment, if contraband is found and no adequate explanation for the presence of the contraband can be presented.

Locks of many types have been designed for, or used in connection with, transportation containers. Smugglers are often expert, however, at breaking into such locks in a manner which will permit concealment of contraband and which will avoid detection. Similarly, security seals which intend to evidence tampering, and perform little function as a true lock, are often compromised by expert craftsmen who can break such seals and replace or repair the broken parts in a manner which will avoid detection. The seals are opened, the contraband is hidden, and the container is resealed in such a manner that visual observation will not readily reveal that the container has been opened.

SUMMARY OF THE INVENTION

It is an object of the invention to provide a security seal for large container closures which will readily reveal tampering.

It is another object of the invention to provide a security seal for large container closures with sufficient strength to withstand the rigors of transportation on ships, trucks, airplanes, trains and the like.

It is another object of the invention to provide a security seal for large container closures which can reveal tampering by several different methods of indication.

It is yet another object of the invention to provide a security seal for large container closures with seal-identifying indicia that cannot readily be altered or replaced.

It is still another object of the invention to provide a security seal for large container closures which is relatively low in cost.

It is yet another object of the invention to provide a security seal for large container closures which can be utilized by employees with limited training.

These and other objects are accomplished by a security seal having a first seal member with a first locking portion and a first detection circuit portion, and a second seal member having a second locking portion and a second detection circuit portion. The first locking portion can be engaged to the second locking portion to engage the first seal member to the second seal member. Structure is provided for connecting the first detection circuit portion to the second detection circuit portion. Engagement of the first seal member to the second seal member preferably also connects the first detection circuit portion to the second detection circuit portion to provide a combined detection circuit throughout the security seal.

Each of the first seal member and second seal member preferably comprise a base portion and a stem portion. The stem portion of the first seal member can be in the general form of a spear, and the stem portion of the second seal member can be in the general form of a sleeve adapted to receive the spear. The first and second locking portions are adapted such that when the spear is inserted into the sleeve it is irretrievably locked into the sleeve. The spear and sleeve can be positioned through the staple and over the hasp of a container and engaged to one another to form a locking stem. The base portions are dimensioned to prevent passage through the staple, such that engagement of the spear in the stem and through the staple will irremovably lock the security seal to the staple and the hasp. A frangible portion is preferably provided in the spear such that a portion of the spear will give way should there be an attempt to forcibly separate the first seal member from the second seal member.

The security seal is preferably formed of a strong and transparent material. Plastic materials such as polycarbonates and styrene butadiene resins are presently preferred. Matching serial numbers are preferably molded or otherwise embedded within the transparent material to provide security seal identification which is easily viewed, but which cannot easily be altered or replaced owing to its embedded position within the plastic.

The security seal of the invention provides several possible indications of tampering. The first and second detection circuit portions preferably comprise electrical conductors which make electrical contact when the respective seal members are engaged to one another. Should the security seal be cut or otherwise broken, the electrical continuity of the detection circuit will be broken. Detection circuits comprising electrical conductors can be readily tested by the provision of surface contacts and a simple electrical continuity tester. The transparent material from which the security seal is made will deform upon tampering to provide a visual indication of such tampering. Should there be any attempt to forcibly separate the first seal member from the second seal member, the frangible portion of the spear will give way, leaving a portion of the spear embedded in the sleeve as evidence of the removal. Further, the matching serial numbers embedded within the plastic, and which will be recorded by the transportation company, are difficult to alter owing to their embedded position within the transparent material and will thereby provide an indication of the removal and replacement of the security seal.

BRIEF DESCRIPTION OF THE DRAWINGS

There are shown in the drawings embodiments which are presently preferred, it being understood that the invention is not limited to the precise arrangements and instrumentalities shown, wherein:

FIG. 5 is a cross-section taken along line 5—5 in FIG. 1.

FIG. 6 is a cross-section taken along line 6—6 in FIG. 1.

FIG. 7 is a cross-section taken along line 7—7 in FIG. 1.

FIG. 8 is a cross-section taken along line 8—8 in FIG. 1.

FIG. 9 is a cross-section taken along line 9—9 in FIG. 1.

FIG. 10 is a cross-section taken along line 10—10 in FIG. 2.

DETAILED DESCRIPTION OF PREFERRED EMBODIMENTS

Figure 1:
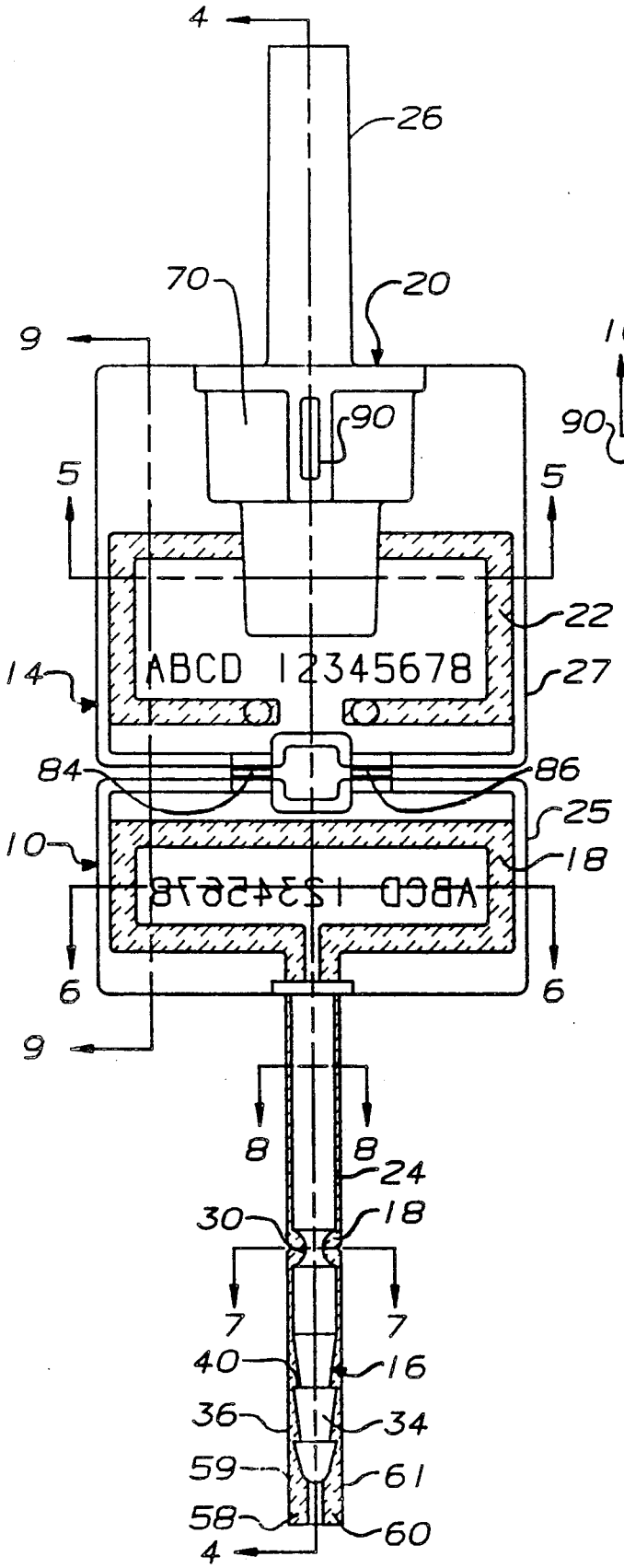
FIG. 1 is a plan view of an unseparated seal member according to the invention.
Figure 2:
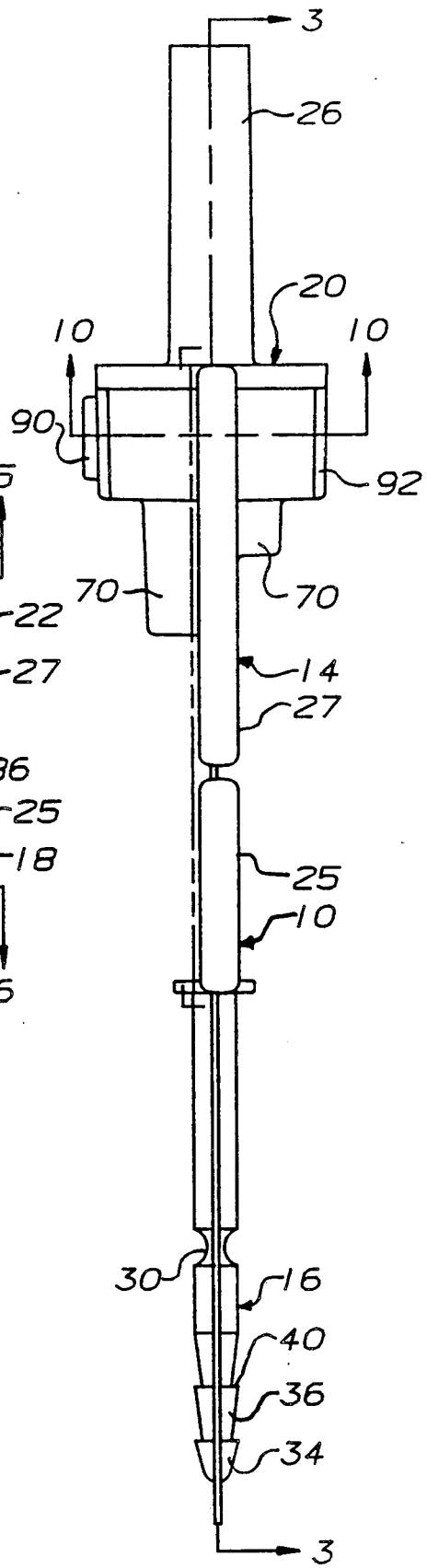
FIG. 2 is a side elevation.

A security seal assembly according to the invention, as shown in the drawings, has a first seal member 10 and a second seal member 14. The first seal member 10 has a first locking portion 16 and a first detection circuit portion 18, and the second seal member 14 has a second locking portion 20 and a second detection circuit portion 22. The first locking portion 16 can be engaged to the second locking portion 20 to engage the first seal member 10 to the second seal member 14. The first detection circuit portion 18 is connectable to the second detection circuit portion 22. Engagement of the first seal member 10 to the second seal member 14 preferably connects the first detection circuit portion 18 to the second detection circuit portion 22 to provide a combined detection circuit throughout the security seal. Any attempt to break the security seal will break continuity of the detection circuit, which break in continuity can be detected either visually or with suitable continuity testing apparatus.

The first detection circuit portion 18 and second detection circuit portion 22 preferably comprise electrical conductors. Leads provided for each respective detection circuit contact one another when the first seal member 10 and second seal member 14 are engaged to one another, to form a combined detection circuit throughout the security seal. Any break in the continuity of this circuit can be detected by the application of a simple electrical continuity tester 23.

The first seal member 10 and second seal member 14 preferably each comprise an elongated stem portion. The first seal member 10 can include an elongated male fitting or spear 24 and a base 25, and the second seal member can include an elongated female fitting or sleeve 26 and a base 27. The male fitting or spear 24 is adapted for insertion into the female fitting or sleeve 26. This insertion engages the first locking portion 16 to the second locking portion 20, and connects the first detection circuit portion 18 to the second detection circuit portion 22.

The first locking portion 16 and second locking portion 20 can be selected from several suitable constructions. A presently preferred construction is shown in the figures, however, alternative locking structures are also possible. The first locking portion 16 preferably includes a plurality of ratchet portions 34, which include inclined surfaces 36 and locking surfaces 40. The second locking portion 20 preferably includes structure for flexibly receiving and locking the ratchet portions 34 when the spear 24 is inserted into the sleeve 26. Such structure can be selected from several possibilities, however, a preferred construction includes the split finger locking ring 44 which has a number of circumferentially arranged, flexible fingers 48 protruding inwardly and rearwardly relative to the long axis of the sleeve 26. A center opening 50 in the locking ring 44 permits the insertion of the spear 24 past the fingers 48. Additional locking ring assemblies such as the innermost split-finger locking ring 54 can be provided for additional engagement strength and additional security, as it is difficult to pry past two of the rings in series. The spear 24 preferably includes a frangible portion 30 which can be an area of reduced cross-sectional area relative to other portions of the spear 24.

Figure 3:
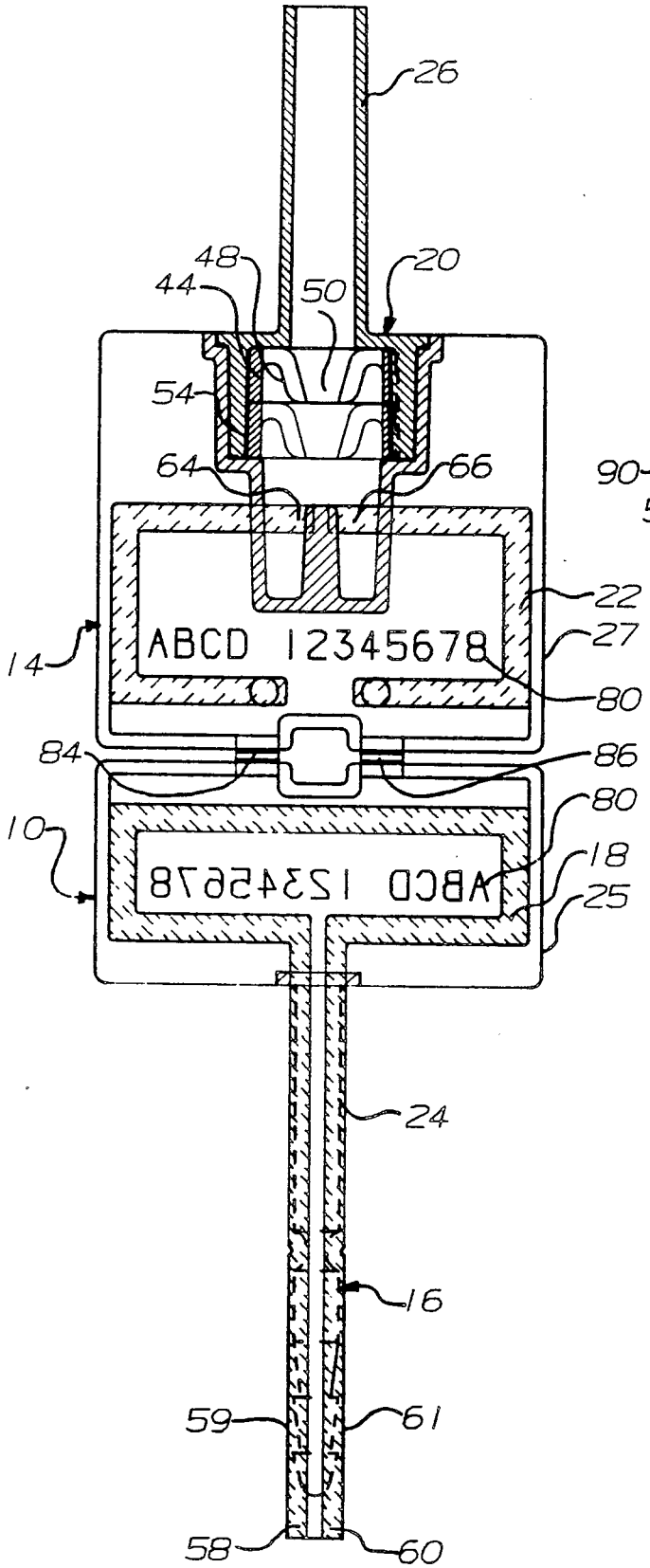
FIG. 3 is a cross-section taken along the line 3—3 in FIG. 2.
Figure 4:
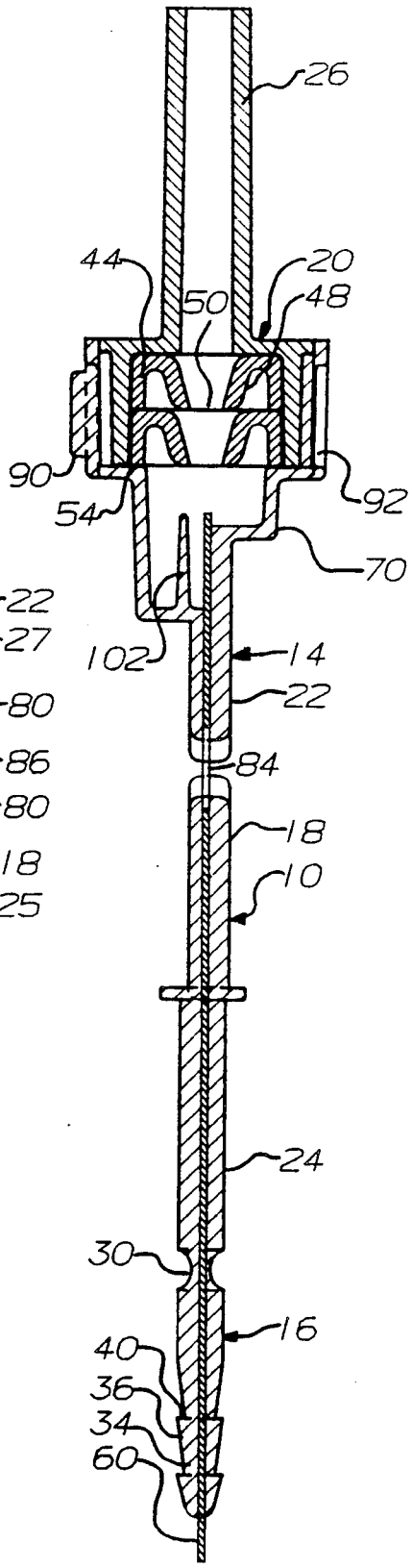
FIG. 4 is a cross-section taken along line 4—4 in FIG. 1.
Figure 11:
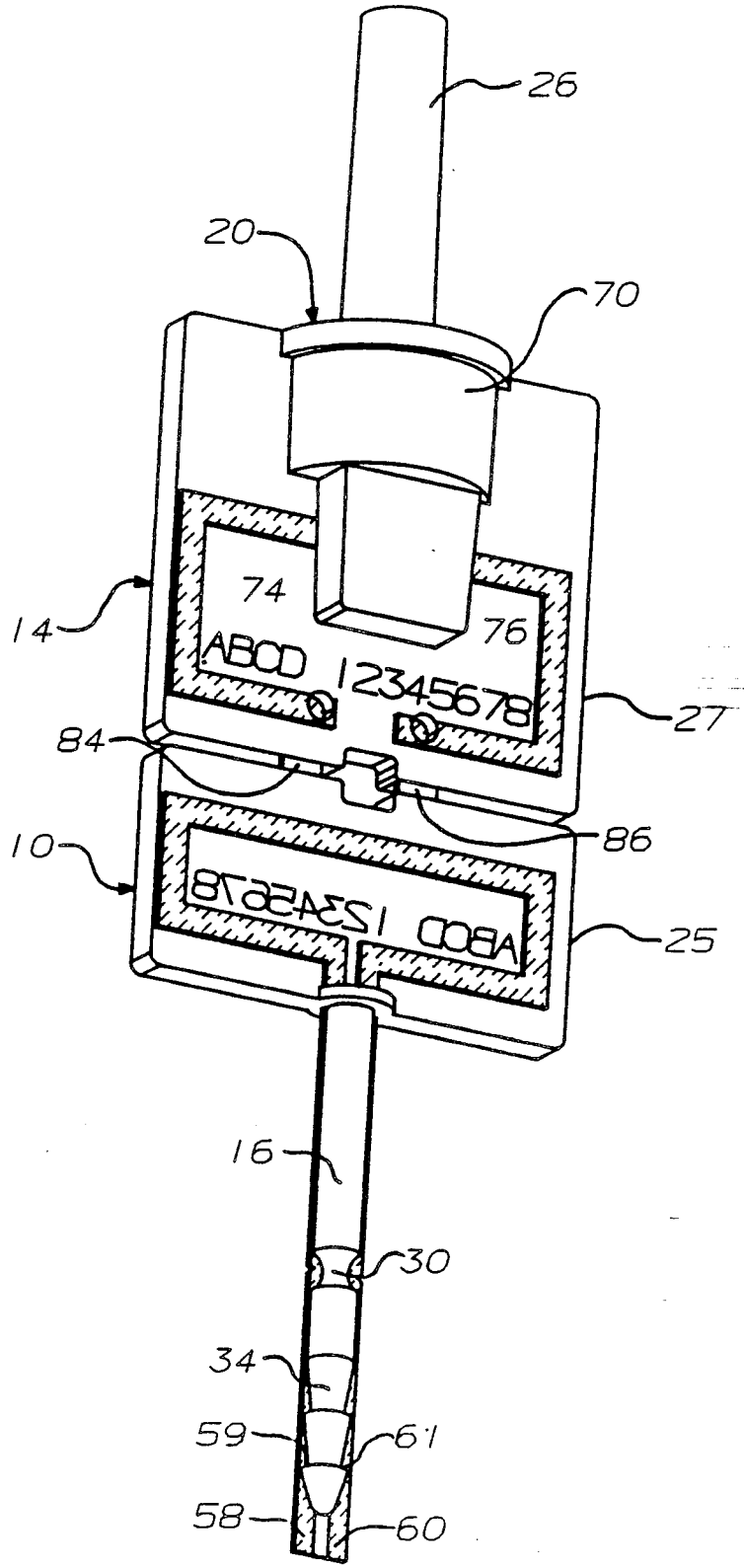
FIG. 11 is a top perspective view.
Figure 12:
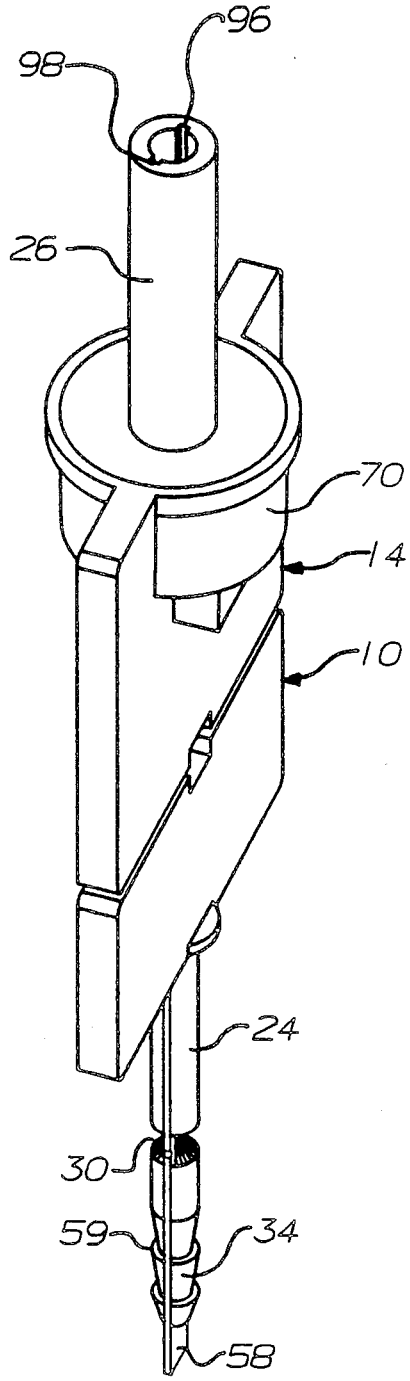
FIG. 12 is a bottom perspective view.
Figure 13:
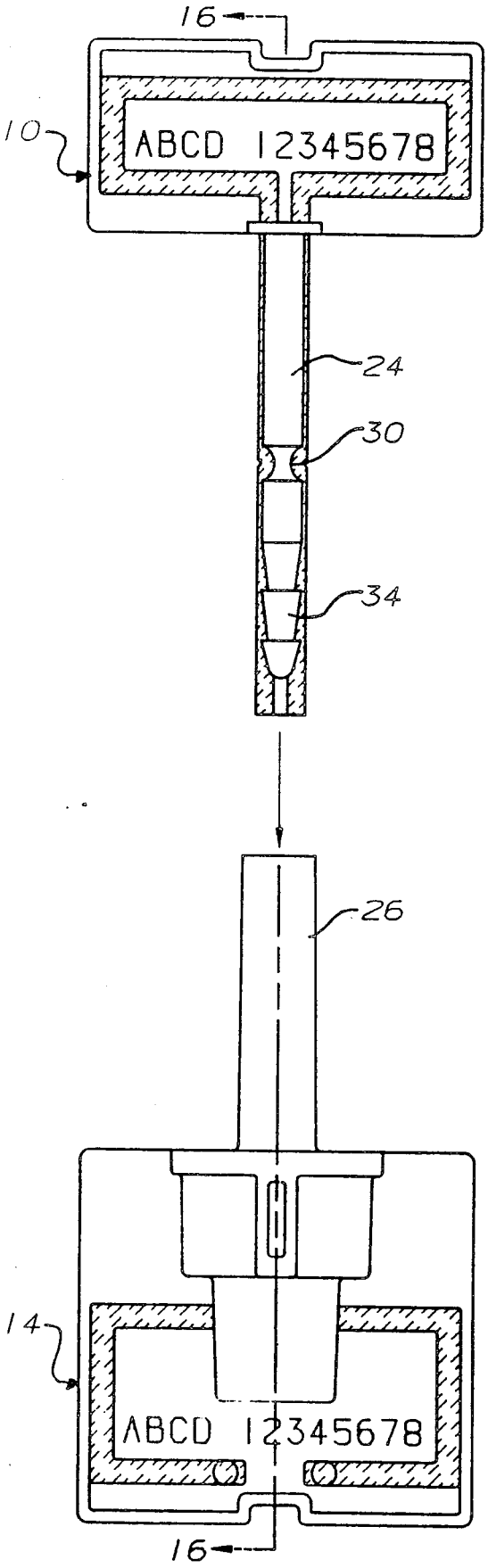
FIG. 13 is an exploded view illustrating an attachment of seal members to one another.
Figure 14:
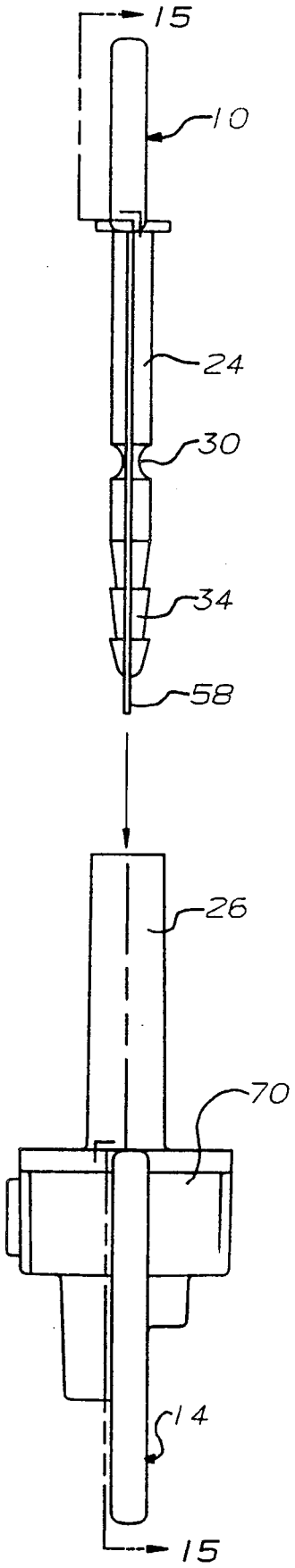
FIG. 14 is a side elevation.
Figure 15:
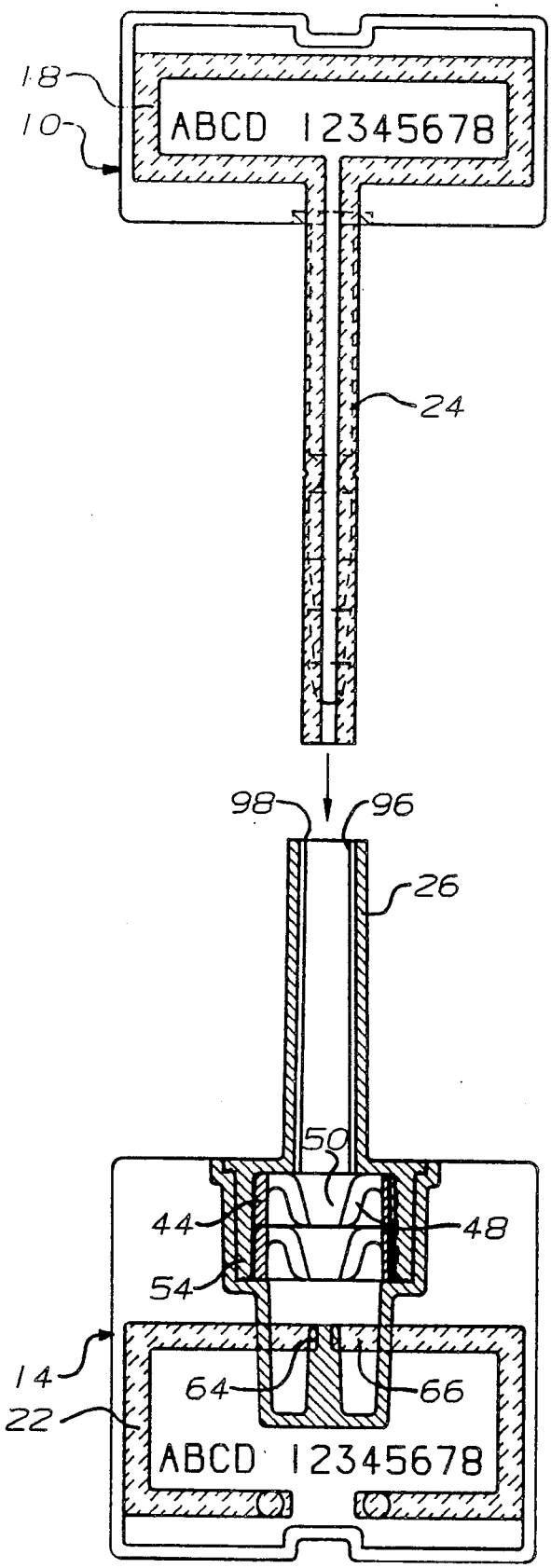
FIG. 15 is a cross-section taken along line 15—15 in FIG. 14.
Figure 16:
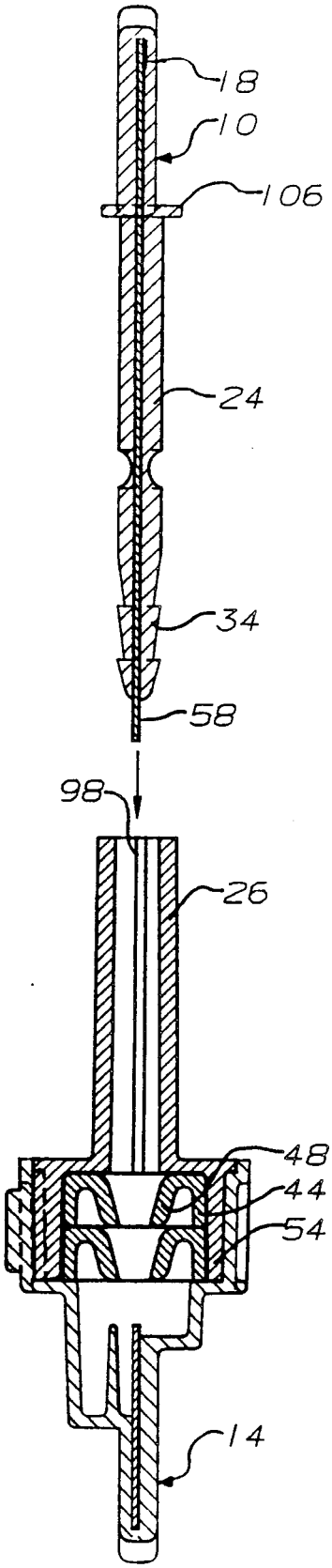
FIG. 16 is a cross-section taken along line 16—16 in FIG. 13.
Figure 17:
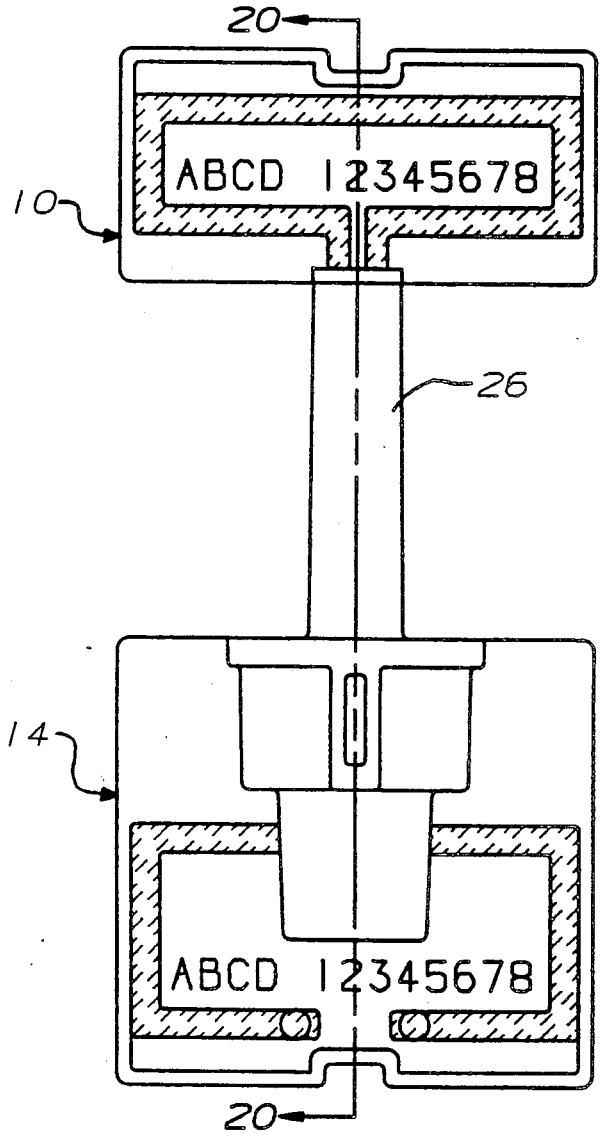
FIG. 17 is a plan view of engaged seal members.
Figure 18:
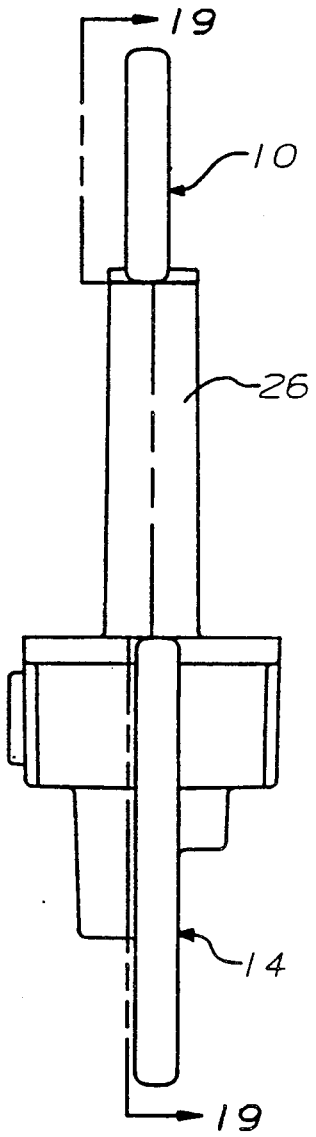
FIG. 18 is a side elevation.

The electrical conductors of the first detection circuit portion 18 and second detection circuit portion 22 can be respectively positioned in the first seal member 10 and second seal member 14 in many possible patterns. The detection circuit portions should traverse each of the first seal member 10 and second seal member 14 in a manner such that a substantial portion of either seal member cannot be removed without breaking a portion of the detection circuit and thereby disrupting continuity of the electrical circuit. It is preferred that the first detection circuit portion 18 and second detection circuit portion 22 substantially traverse respective peripheral portions of the first seal member 10 and second seal member 14, and that the detection circuit portions located in the base portions 25, 27 be substantially embedded within the seal members 10, 14 as shown particularly in FIGS. 3–4. Leads of the first detection circuit portion 18 preferably extend down each side of the spear 24 substantially to an end distal to the base 25, as at contact points 58, 60. The spear 24 preferably includes side flanges 59, 61 onto which the leads of the first detection circuit portion 18 are laid during the manufacturing process. The second detection circuit portion 22 extends to contacts 64, 66 within a lock housing 70 which forms part of the second locking portion 20. Opposite ends of the second detection circuit 22 can be provided as testing contacts 74, 76 for the application of the leads of a suitable continuity tester 23.

It is preferable that the first seal member 10 and second seal member 14 be constructed of a rigid and durable material. It is also preferable that the material be substantially transparent, so as to readily make evident any breakage and attempted repair. Durable, transparent plastics are presently preferred materials, and polycarbonates and styrene butadiene resins are typical.

It is desirable to encode indicia 80 for identifying a particular security seal member into each of the first seal member 10 and second seal member 14. It is preferred that the indicia on the first seal member 10 and second seal member 14 be substantially identical. In this manner, registration of each seal member is possible, and replacement with the properly encoded multi-digit identifying indicia is necessary to conceal tampering. The identifying indicia 80 are preferably substantially embedded within the material of the first seal member 10 and second seal member 14 to impair or prevent undetectable alteration of the identifying indicia. The indicia can be provided in alpha-numeric form, or in alterative forms such as bar code encoding systems.

The first seal member 10 and the second seal member 14 can be engaged together prior to use by frangible attachment portions 84, 86. Seal members having corresponding identifying indicia 80 will thereby be retained together during storage and before use. The frangible portions 84, 86 can be manually separated when it is desired to secure the respective seal members together. A cooperating key 90 and slot 92 can be provided on each locking portion 70 to facilitate the stacking several of the unseparated seal members for packing and shipping.

Figure 19:
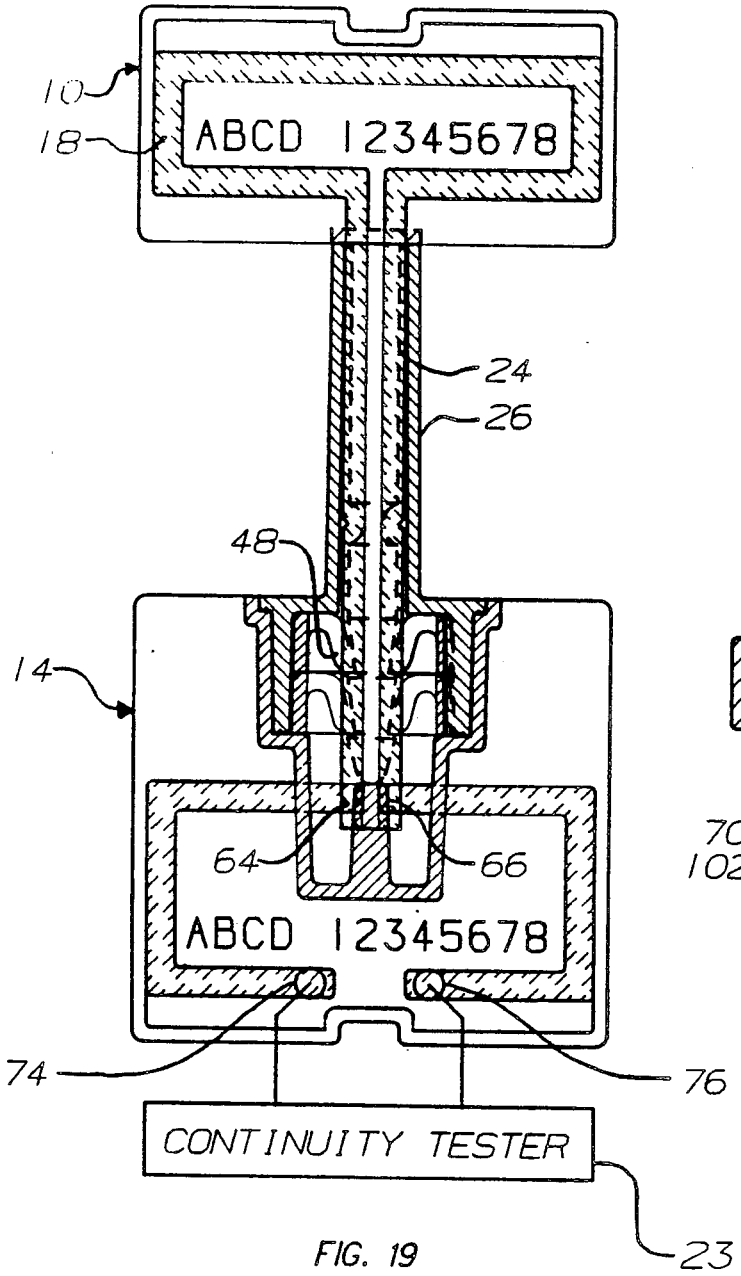
FIG. 19 is a cross-section taken along line 19—19 in FIG. 18.
Figure 20:
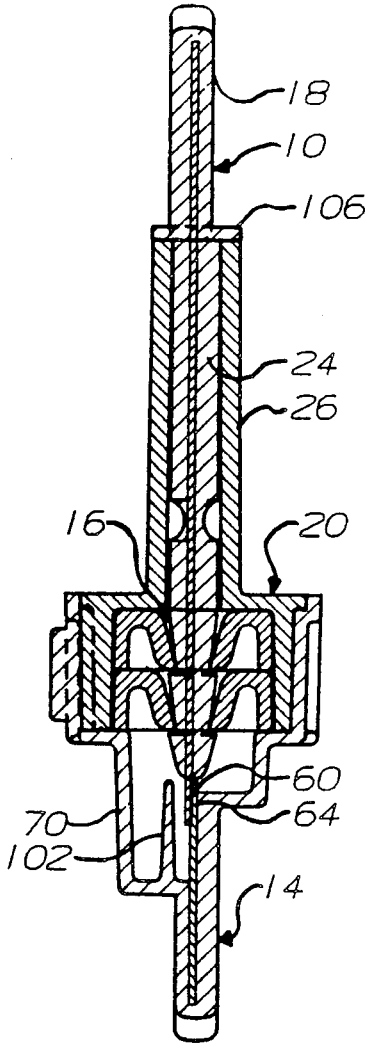
FIG. 20 is a cross-section taken along line 20—20 in FIG. 17.
Figure 23:
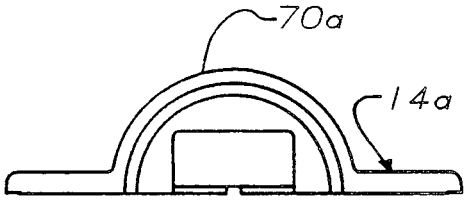
FIG. 23 is a front elevation.
Figure 21:
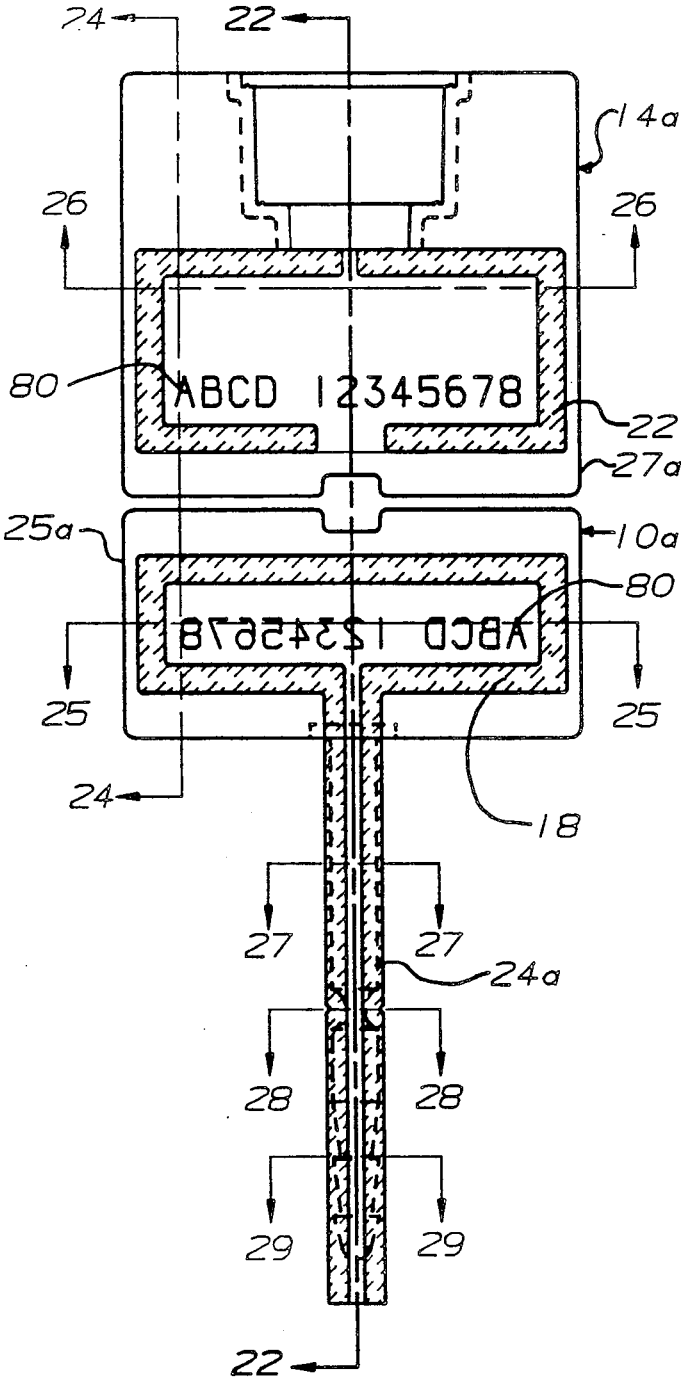
FIG. 21 is a plan view of a seal member according to the invention during a first stage of assembly.
Figure 22:
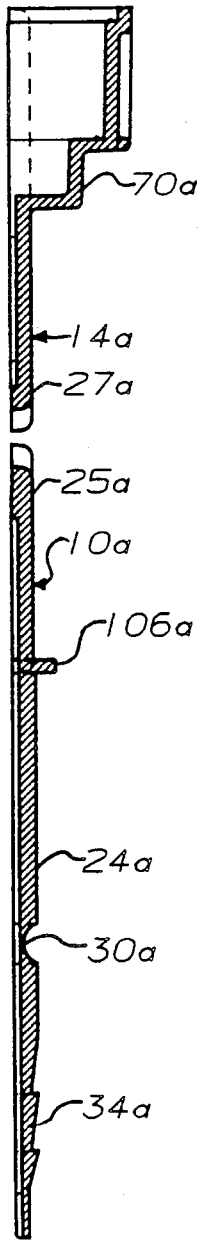
FIG. 22 is a cross-section taken along line 22—22 in FIG. 21.
Figure 24:
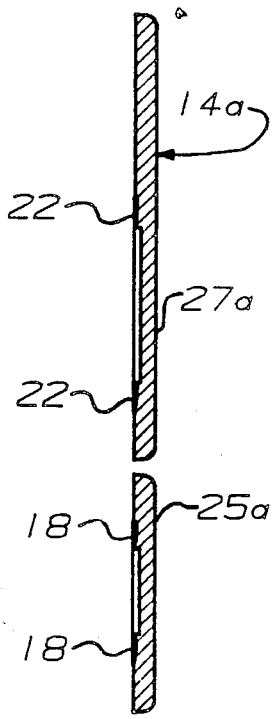
FIG. 24 is a cross-section taken along line 24—24 in FIG. 21.
Figure 26:
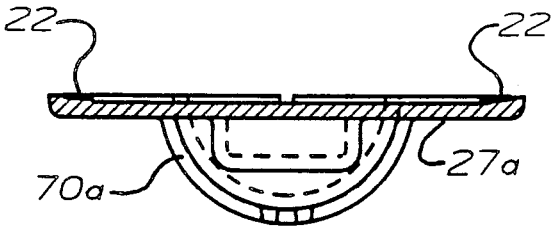
FIG. 26 is a cross-section taken along line 26—26 in FIG. 21.
Figure 25:
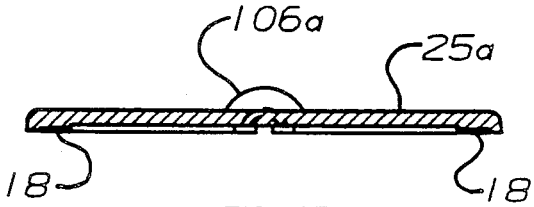
FIG. 25 is a cross-section taken along line 25—25 in FIG. 21.
Figure 27:
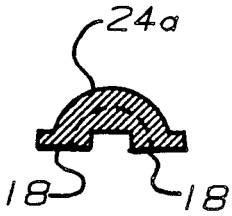
FIG. 27 is a cross-section taken along line 27—27 in FIG. 21.
Figure 28:
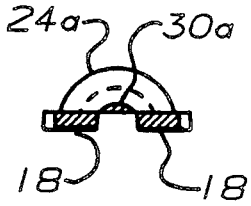
FIG. 28 is a cross-section taken along line 28—28 in FIG. 21.
Figure 29:
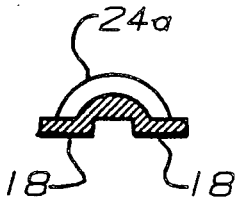
FIG. 29 is a cross-section taken along line 29—29 in FIG. 21.
Figure 31:
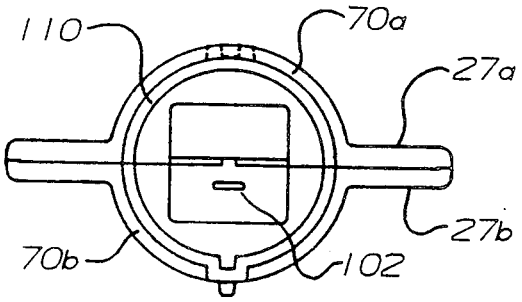
FIG. 31 is a rear elevation.
Figure 30:
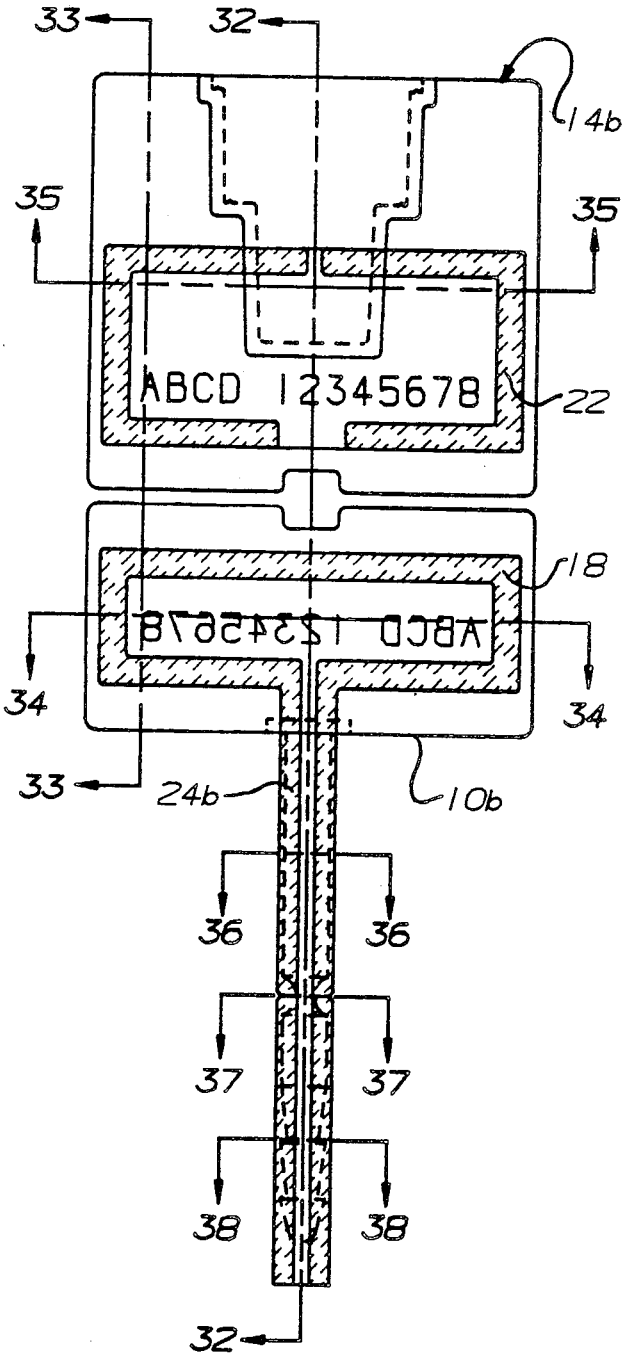
FIG. 30 is a plan view of a seal member at a second stage of assembly.
Figure 32:
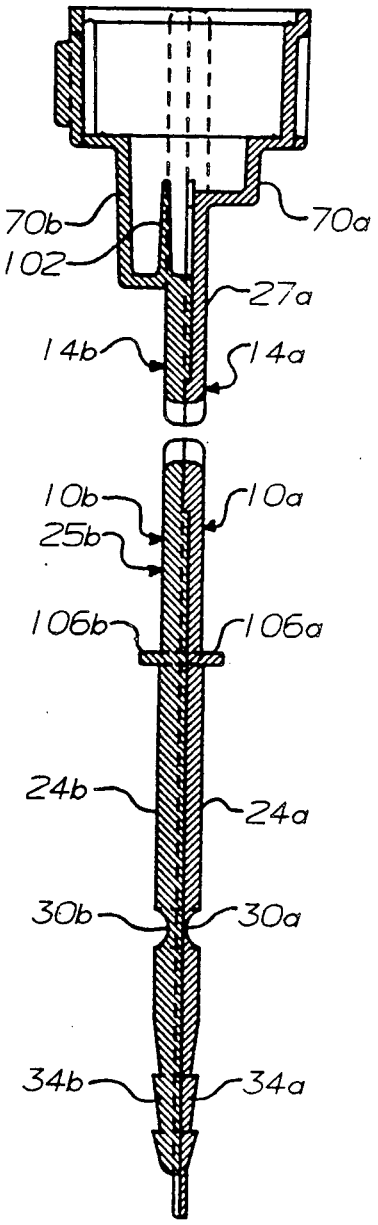
FIG. 32 is a cross-section taken along line 32—32 in FIG. 30.
Figure 33:
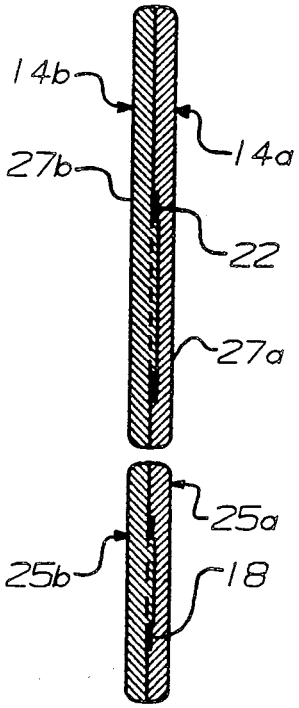
FIG. 33 is a cross-section taken along line 33—33 in FIG. 30.
Figure 35:
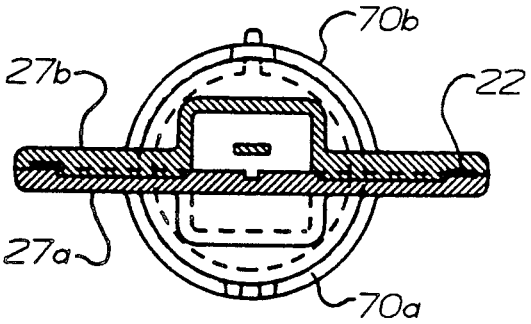
FIG. 35 is a cross-section taken along line 35—35 in FIG. 30.
Figure 34:
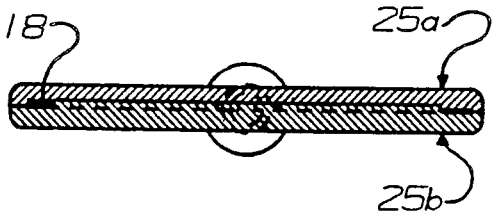
FIG. 34 is a cross-section taken along line 34—34 in FIG. 30.
Figure 36:
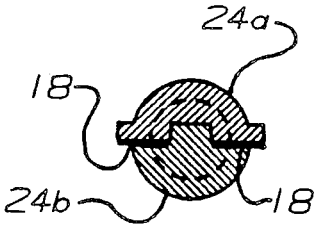
FIG. 36 is a cross-section taken along line 36—36 in FIG. 30.
Figure 37:
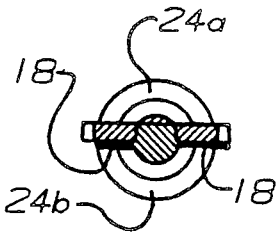
FIG. 37 is a cross-section taken along line 37—37 in FIG. 30.
Figure 38:
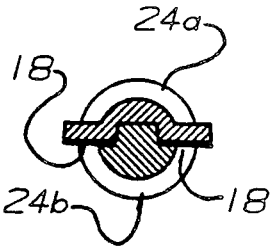
FIG. 38 is a cross-section taken along line 38—38 in FIG. 30.
Figure 39:
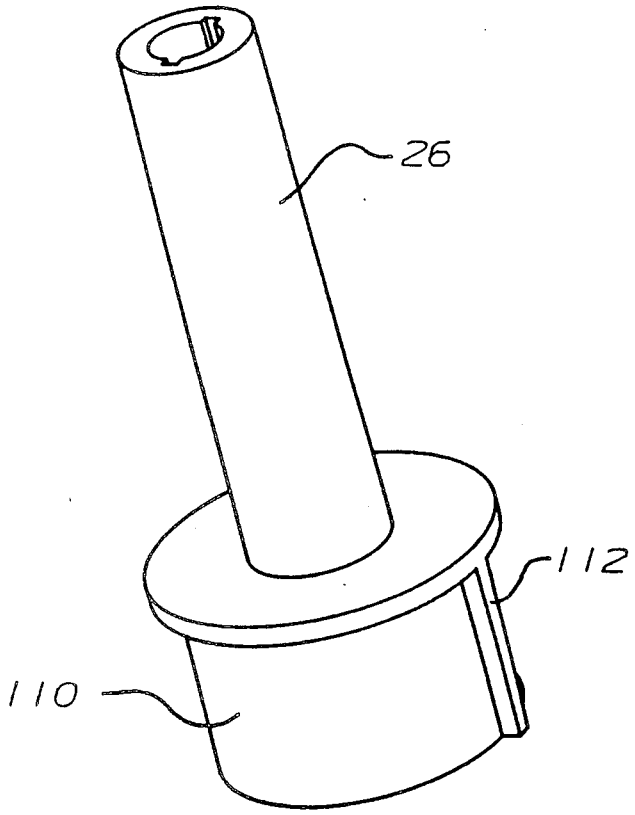
FIG. 39 is a perspective view of a sleeve according to the invention.
Figure 40:
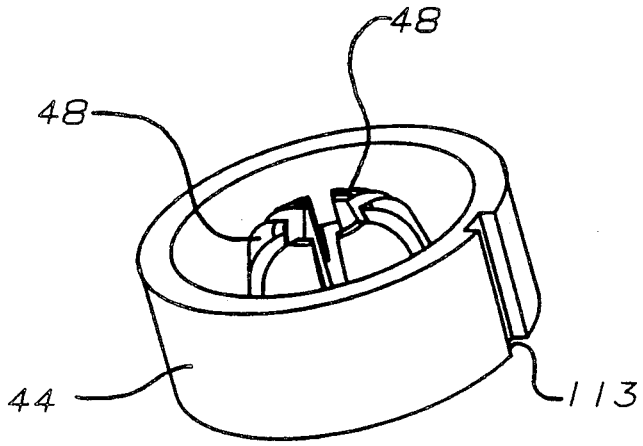
FIG. 40 is a perspective view of a split-finger locking ring.

In operation, the seal-member identifying indicia 80 is recorded in connection with a particular container number prior to installation. Peel-off adhesive labels bearing the seal-member indicia can also be supplied and adhered directly to a shipping invoice or ledger for the particular container to facilitate the recordal of security seal numbers with container numbers. The first seal member 10 and second seal member 14 are then separated by breaking the frangible connecting portions 84, 86. The first seal member 10 is then inserted into the second seal member 14 by placing the spear 24 within the sleeve 26. It is possible to key the sleeve 26 with slots 96, 98 which are adapted to receive the flanges 59, 61 of the spear 24 so as to insure proper positioning of the spear 24 in the sleeve 26 (FIGS. 14–17). The spear 24 is then moved through the sleeve 26 until the ratchet portions 34 pass through the aperture 50 of the split-finger locking rings 44, 54. The aperture 50 is smaller in diameter than the largest diameter of the ratchet portions 34. The fingers 48 will elastically deform as they contact the inclined surfaces 36 of the ratchet portions 34 and will thereafter spring behind and engage the locking surfaces 40 of the ratchet portions 34 to securely engage the locking portion 16 of the first seal member 10 to the locking portion 20 of the second seal member 14 (FIGS. 19–20).

The contact surfaces 58, 60 of the first detection circuit portion 18 are positioned adjacent to the contact surfaces 64, 66 of the second detection circuit portion 22 upon engagement of the first locking portion 16 to the second locking portion 20, so as to provide an electrical connection between the first detection circuit portion 18 and the second detection circuit portion 22. This will provide a combined detection circuit throughout the security seal. Spring means 102 can be provided within the lock housing 70 to urge the contacts 58, 60 of the spear 24 against the contacts 64, 66 and to thereby improve continuity. The spring 102 can be substantially wedge-shaped and slightly off-center relative to the position of the side flanges 59, 61 when positioned within the lock housing 70. In this manner, the side flanges 59, 61 will contact the wedge-shaped spring 102 and will be urged toward the contacts 64, 66 as the spear 24 is pushed further through the sleeve 26 and into the lock housing 70. A seal 106 can be provided on the spear 24 to completely seal the opening of the sleeve 26 distal to the base 25 (FIG. 20) and to thereby prevent access to the locking rings.

The first seal member 10 and second seal member 14 can be positioned through the staple of a closure, and over the hasp, and thereafter engaged to one another to secure the seal member in position. Base portions 25, 27 are dimensioned so that they cannot pass through the staple, so that once the first seal member 10 and second seal member 14 are engaged to one another the seal member cannot be removed from the hasp. The seal member could also be connected from lids and doors to containers by other means, for example, through aligned openings in each.

The seal member of the invention provides several different indications of tampering. The transparent material of which the seal members are made will be visibly deformed, and will usually turn opaque, should the material be broken or severely stressed. Any attempt to cut the seal member will break continuity of the combined detection circuit portions 18 and 22, which break in continuity can be quickly determined by the application of a continuity tester 23 to the contacts 74, 76 (see FIG. 19). The seal member identifying indicia 80 can be recorded prior to shipping for the particular container number to which the seal member will be applied. The number of indicia is sufficiently large that it is very unlikely that a smuggler would have a duplicate on hand. The embedded position of the indicia 80 within the seal member material would require that a copy be independently manufactured, a process which cannot be accomplished in the short time available to the smuggler. Should an attempt be made to pry the first seal member 10 from the second seal member 14, the frangible portion 30 will give way, leaving the distal end of the spear 24 securely locked within the sleeve 26 as yet another indication of tampering. Finally, it is possible to embed a hologram within the material of the seal members, which hologram is difficult to duplicate without sophisticated equipment.

The seal members according to the invention can be manufactured by a number of suitable processes. One such process is illustrated in FIG. 21–40. An approximately one-half longitudinal section of the first seal member 10*a* and second seal member 14*a* is initially molded. Corresponding portions such as the spear portions 24*a*, base portions 25*a*, frangible portion 30*a*, ratchet portions 34*a*, and seal 106*a* are molded as part of the first seal member 10*a*, while corresponding features such as the lock housing portion 70*a* and base portion 27*a* are molded as part of the second seal member portion 14*a*. The first detection circuit portion 18 and second detection circuit portion 22 are then applied by suitable processes such as the roller application of conductive paints, vapor deposition of conductive materials, mechanical application of thin metal foils, and the like. The identifying indicia 80 can be applied by suitable processes including laser etching, hot stamping or ink jet printing. The indicia 80 on the first seal member portion 10*a* and second seal member portion 14*a* are preferably substantially mirror images of one another, such that when the portions are completely molded and locked together the indicia will be properly oriented for reading or decoding.

The first seal member portion 10*a* and second seal member portion 14*a*, with the first detection circuit portion 18 and second detection circuit portion 22 and identifying indicia 80 in place, are then over-molded to complete the piece. Corresponding portions 10*b* of the first seal member, including the spear portion 24*b*, base portion 25*b*, frangible portion 30*b* and ratchet portions 34*b*, are formed. Similarly, the second seal member portion 14*b* includes a corresponding base portion 27*b*, lock housing 70*b*, and spring 102. Apertures are formed in the plastic over the contacts 74 and 76, to permit access by the leads of a testing device. The completed, unseparated assembly after molding does not include all of the second locking portion 20. The sleeve 26 is preferably separately formed and includes an enlarged portion 110 (FIG. 39) which is adapted to retain the split-finger locking rings 44, 54. The split-finger locking rings 44, 54 are positioned in the enlarged portion 110, following which the enlarged portion 110 is inserted into the lock housing 70. A key surface 112 can be fitted into a corresponding slot formed on an interior surface of the lock housing 70 to insure proper positioning. Similarly, a slot 113 on the split-finger locking rings 44, 54 can be mated to a corresponding male key surface on the interior of the enlarged portion 110 of the sleeve 26 to insure proper positioning of the split-finger locking rings within the enlarged portion 110. Suitable attachment means, such as adhesives, solvents or sonic welding, can be utilized to secure the assembly together.

Figure 41:
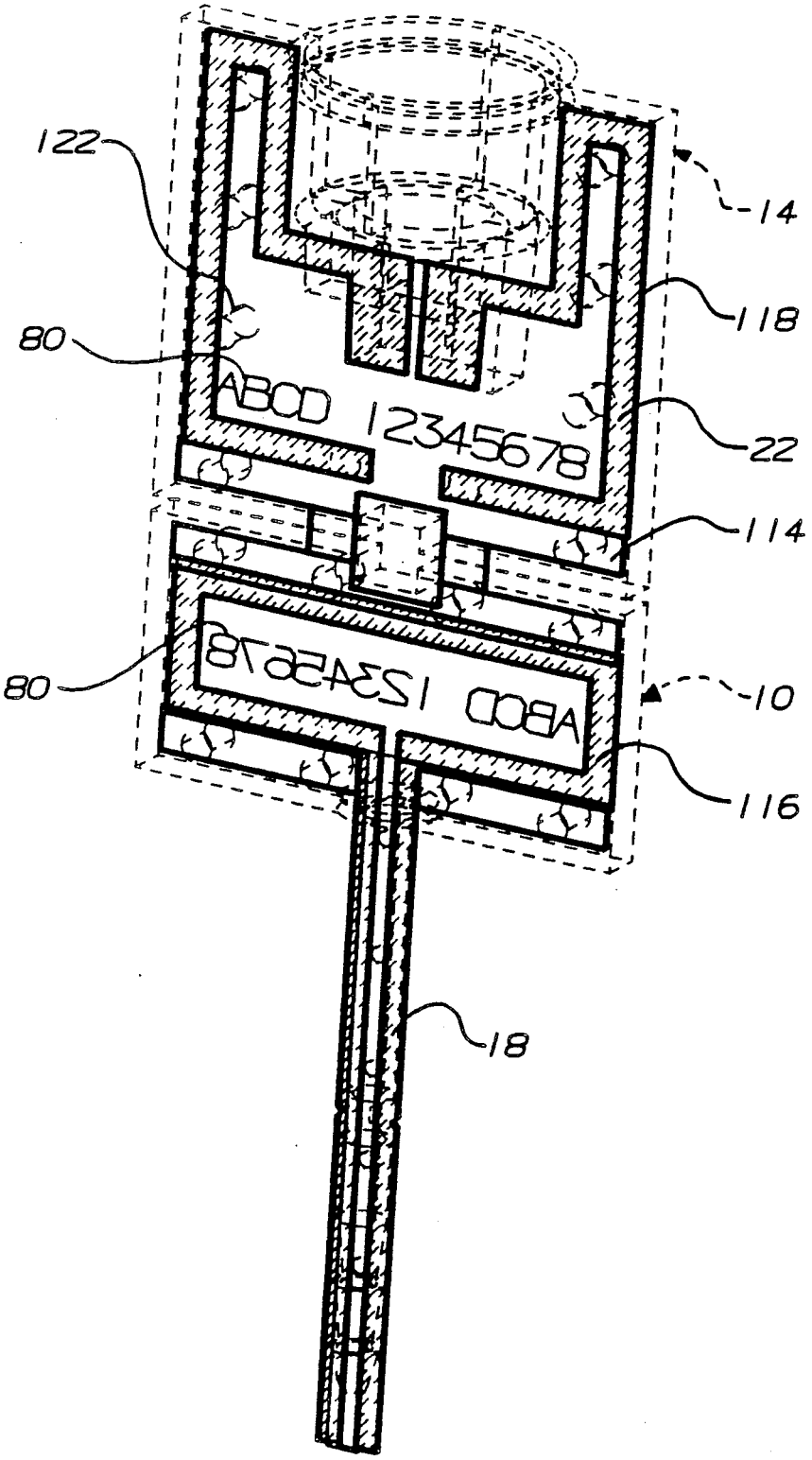
FIG. 41 is a perspective view of a card as utilized in a second of manufacture, partially in phantom.
Figure 42:
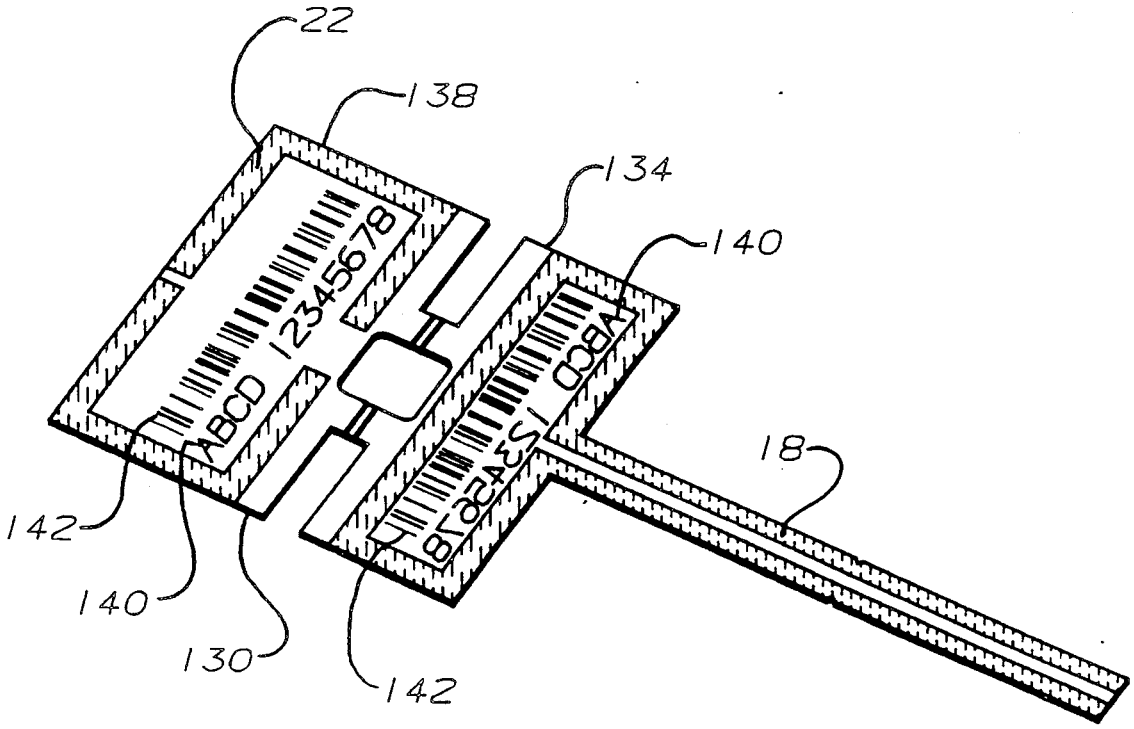
FIG. 42 is a perspective view of a card as utilized in a third method of assembly.

Other assembly methodologies are also possible. A card 114 can be provided with card portions 116, 118 (FIG. 41). The card 114 is embedded within the first seal member 10 and second seal member 14 (phantom lines) during subsequent molding operations. The first detection circuit portion 18 and second detection circuit portion 22 are applied to the card 114 by suitable methods. The identifying indicia 80 can also be formed directly on the card 114 at this stage. Subsequent molding operations apply remaining portions of the first seal member 10 and second seal member 14 such that the card portions 116, 118, together with the first detection circuit portion 18, second detection circuit portion 22 and any identifying indicia 80, are substantially embedded within the seal members. Apertures can be provided in the card 114 to permit the insertion of mechanical gripping means to facilitate proper positioning of the card 11 during the subsequent molding operations, and to allow for a flow of plastic through the card during molding to thoroughly embed the card in the plastic.

Figure 45:
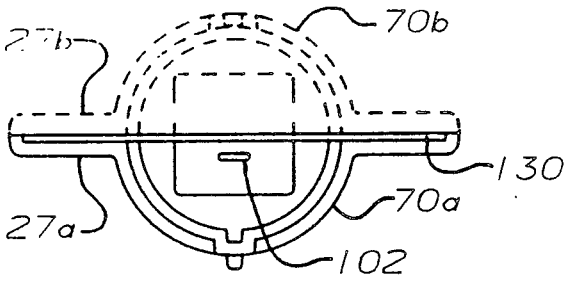
FIG. 45 is a front elevation, partially in phantom.
Figure 43:
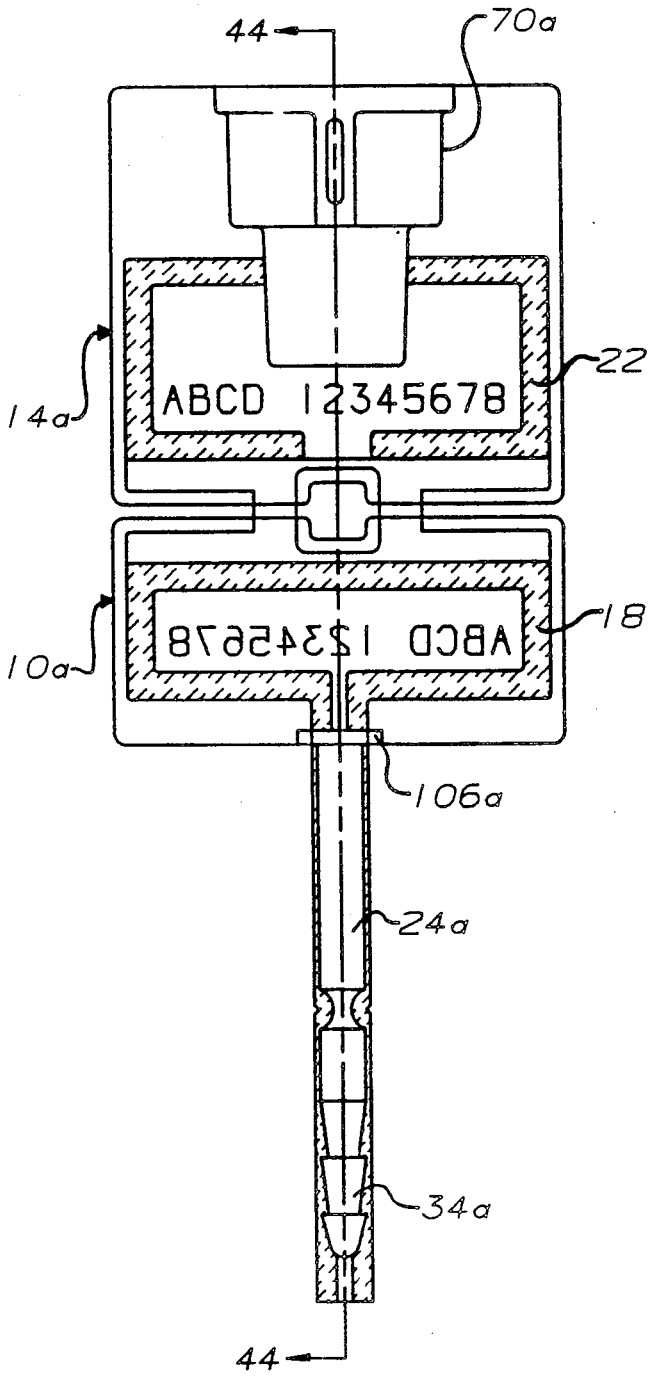
FIG. 43 is a plan view of unseparated seal members at an intermediate stage of assembly, and according to a third method of manufacture.
Figure 44:
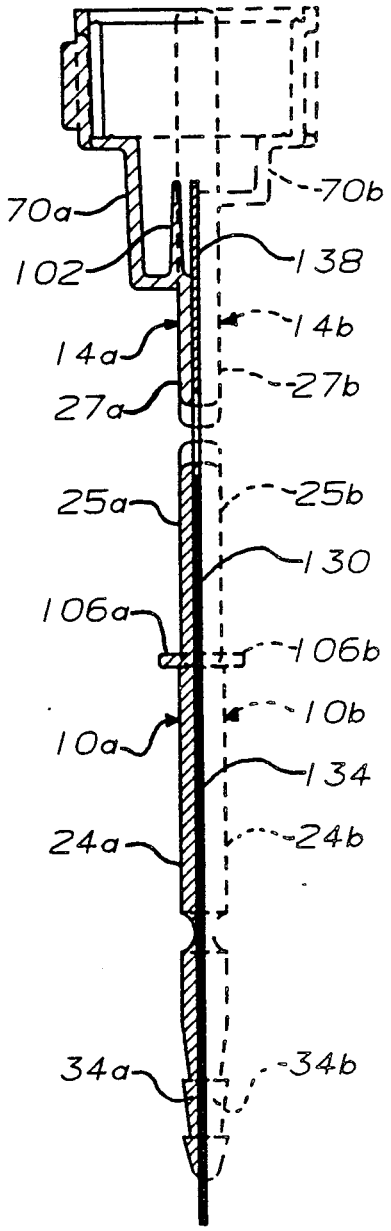
FIG. 44 is a cross-section taken along line 44—44 in FIG. 43, partially in phantom.

Still another methodology is presently preferred. A card 130, which can be substantially planar, includes a first portion 134 and a second portion 138 joined together by bridge portions 140, 142. The first circuit portion 18 and second circuit portion 22 are provided on the first portion 134 and second portion 138, respectively. This can be accomplished by providing a substantially continuous layer of conductive material on the card 130, and then etching portions of the conductive material away by suitable techniques such as laser etching. Other circuit forming techniques can also be utilized. Alpha-numeric indicia 140 and bar codes 142 can also be provided on the card 130. The alphanumeric indicia 140 and bar code 142 can be formed utilizing the same etching techniques used for the conductive material, or can be separately formed using alternative processes such as stamping or printing. First portions of the seal members 10 and 14 are molded separately. The molded piece can, for example, represent a substantially one-half section of the final molded piece, wherein a portion 10*a* includes a spear portion 24*a*, a ratchet portion 34*a*, a base portion 25*a* and a seal portion 106*a*. A second seal member portion 14*a* can include a base portion 27*a*, a lock housing portion 70*a* and the spring 102. The card 130 is then positioned on the piece, and remaining portions of the first seal member 10 are molded (phantom lines in FIGS. 44–45) including the seal member portion 24*b*, the base portion 25*b*, the ratchet portion 34*b* and the seal portion 106*b*. A remaining portion 14*b* of the second seal member 14 is also molded and includes a base portion 27*b* and a lock housing 70*b*. The card 130, and particularly the first circuit portion 18 and second circuit portion 22, are thereby embedded within the first seal member 10 and second seal member 14.

The invention provides a durable, tamper-resistant seal member which can be inexpensively manufactured for use on a large volume of shipping containers and other items requiring tamper-evident closures for lids and doors. The precise conformations, constructions, and methods of manufacture can be varied without departing from the spirit or essential attributes of the invention, and accordingly, reference should be had to the following claims, rather than to the foregoing specification, as indicating the scope of the invention.

We claim:

1. A security seal, comprising:

a first seal member having a first locking portion and a first detection circuit portion; and a second seal member having a second locking portion and a second detection circuit portion, said first locking portion being engagable to said second locking portion, and structure for connecting said first circuit portion to said second circuit portion when said first locking portion is engaged to said second locking portion;

wherein said structure for connecting said first circuit portion to said second circuit portion is operatively connected to said first locking portion and said second locking portion such that engagement of said first seal member to said second seal member operatively connects said first detection circuit portion to said second detection circuit portion to provide a combined detection circuit throughout said security seal;

wherein first and second detection circuit portions comprise an electrical conductor, engagement of said first locking portion to said second locking portion making electrical contact between said first and second detection circuit portions, said first and second detection circuit portions further comprising electrical contacts for the application of an electrical continuity testing means;

wherein said first seal member and said second seal member each comprise a base portion and a stem portion;

wherein the stem of said first seal member comprises a male locking portion, and the stem of said second seal member comprises a female locking portion, said male locking portion being insertable into said female locking portion to secure said first seal member to said second seal member;

wherein said female locking portion and said male locking portion comprise interlocking one-way catch portions; and wherein said female locking portion is substantially in the form of an elongated sleeve, and said male locking portion is substantially in the form of an elongated spear.

2. The security seal of claim 1, wherein leads of said first detection circuit portion extend substantially the length of said spear, contact portions of said leads distal to said base portion making contact with contact portions of leads of said second detection circuit portion within said sleeve.

3. The security seal of claim 2, further comprising spring means within said sleeve adapted to bias said contact portions of said second detection circuit portion with contact portions of said first detection circuit portion.

4. A security seal, comprising:

a first seal member having a first locking portion and a first detection circuit portion; and a second seal member having a second locking portion and a second detection circuit portion, said first locking portion being engagable to said second locking portion, and structure for connecting said first circuit portion to said second circuit portion when said first locking portion is engaged to said second locking portion;

wherein said structure for connecting said first circuit portion to said second circuit portion is operatively connected to said first locking portion and said second locking portion such that engagement of said first seal member to said second seal member operatively connects said first detection circuit portion to said second detection circuit portion to provide a combined detection circuit throughout said security seal;

wherein first and second detection circuit portions comprise an electrical conductor, engagement of said first locking portion to said second locking portion making electrical contact between said first and second detection circuit portions. said first and second detection circuit portions further comprising electrical contacts for the application of an electrical continuity testing means;

wherein said first seal member and said second seal member each comprise a base portion and a stem portion;

wherein the stem of said first seal member comprises a male locking portion, and the stem of said second seal member comprises a female locking portion, said male locking portion being insertable into said female locking portion to secure said first seal member to said second seal member; and wherein said stem of said first seal member comprises a frangible break-away portion.

5. The security seal of claim 1, where each of said first seal member and said second seal member are formed from a rigid, transparent material, and identification indicia are embedded within said transparent material.

6. A security seal, comprising:

a first seal member having a first locking portion and a first detection circuit portion; and a second seal member having a second locking portion and a second detection circuit portion, said first locking portion being engagable to said second locking portion, and structure for connecting said first circuit portion to said second circuit portion when said first locking portion is engaged to said second locking portion;

wherein said structure for connecting said first circuit portion to said second circuit portion is operatively connected to said first locking portion and said second locking portion such that engagement of said first seal member to said second seal member operatively connects said first detection circuit portion to said second detection circuit portion to provide a combined detection circuit throughout said security seal; and wherein said first seal member and said second seal member are formed from a rigid, transparent material.

7. A security seal, comprising:

a first seal member having a first locking portion and a first detection circuit portion; and a second seal member having a second locking portion and a second detection circuit portion, said first locking portion being engagable to said second locking portion, and structure for connecting said first circuit portion to said second circuit portion when said first locking portion is engaged to said second locking portion;

wherein said structure for connecting said first circuit portion to said second circuit portion is operatively connected to said first locking portion and said second locking portion such that engagement of said first seal member to said second seal member operatively connects said first detection circuit portion to said second detection circuit portion to provide a combined detection circuit throughout said security seal; and wherein said first seal member and said second seal member are secured to one another by frangible attachment means, whereby said frangible attachment means can be broken prior to locking said first locking portion to said second locking portion.

8. A method for indicating unauthorized access to the closure of a container, comprising the steps of:

providing a first seal member having a first locking portion and a first detection circuit portion;

providing a second seal member having a second locking portion and a second detection circuit portion;

securing said first seal member and said second seal member to one another and across said closure, said securing of said first locking portion to said second locking portion operatively connecting said first detection circuit portion and said second detection circuit portion to provide a combined detection circuit.

9. The method of claim 8, further comprising the steps of providing embedded seal-member identification indicia in each of said first seal member and said second seal member, and recording said indicia of said first seal member and said second seal member with an identification of the container to which the respective seal member is applied, whereby removal and replacement of said first seal member or said second seal member can be detected.

10. The method of claim 8, wherein said first seal member and said second seal member are attached by frangible attachment means, and further comprising the step of separating said first seal member from said second seal member by breaking said attachment means prior to interlocking said first locking portion to said second locking portion.

11. The method of claim 8, wherein said first detection circuit portion and said second detection circuit portion comprise substantially embedded electrical conductors and electrical contacts for said conductors, and further comprising the step of applying a continuity tester to said contacts to determine whether said continuity has been destroyed through tampering.

12. A security seal comprising first and second members lockably engagable with one another, at least one of said members having electrical conductive means in at least that portion thereof engaged with the other member, at least one of said first and second members including an access to permit electrical contact with said conductive means to determine a compromise of said engaged members.

13. The invention according to one of claim 12 wherein said first member and said second member are formed from a rigid, transparent material.

14. The invention according to claim 13 wherein identifying indicia are embedded wholly within said transparent material.

15. The invention according to claim 12 wherein identifying indicia are embedded wholly within said seal.

16. The invention according to claim 12 wherein said access is provided substantially at opposite ends of said conductive means.

17. The invention according to one of claim 16 wherein said first member and said second member are formed from a rigid, transparent material.

18. The invention according to claim 17 wherein identifying indicia are embedded wholly within said transparent material.

19. The invention according to claim 16 wherein identifying indicia are embedded wholly within said seal.

20. The invention according to claim 16 wherein said access permits a determination of an open circuit condition in said conductive means as a manifestation of the compromise of said security seal.

21. The invention according to claim 12 wherein said access permits a determination of an open circuit condition in said conductive means as a manifestation of the compromise of said security seal.

22. The invention according to claim 21 wherein said first member and said second member are formed from a rigid, transparent material.

23. The invention according to claim 22 wherein identifying indicia are embedded wholly within said transparent material.

24. The invention according to claim 21 wherein identifying indicia are embedded wholly within said seal.

* * * * *